United States Patent [19]

Lopez, Jr.

[11] 4,023,269

[45] May 17, 1977

[54] SHAVING DEVICE

[76] Inventor: Lorenzo Lopez, Jr., 1037 NE. 88th St., Miami, Fla. 33138

[22] Filed: Aug. 30, 1976

[21] Appl. No.: 718,524

[52] U.S. Cl. ..... 30/41

[51] Int. Cl.[2] ..... B26B 21/44

[58] Field of Search ..... 30/41, 86, 90

[56] References Cited

UNITED STATES PATENTS

| | | | |
|---|---|---|---|
| 1,892,836 | 1/1933 | Harvey | 30/41 |
| 2,711,582 | 6/1955 | Scully | 30/90 X |
| 2,786,270 | 3/1957 | Orlando | 30/41 |
| 3,417,468 | 12/1968 | Miyauchi | 30/41 |

*Primary Examiner*—Al Lawrence Smith
*Assistant Examiner*—J. C. Peters

[57] ABSTRACT

A shaving device comprising a handle of tubular material and a cartridge of shaving cream in the handle in snug fitting engagement and including a valve and a razor blade carrier and a brush on the device with the brush being in open fluid communication with the cartridge of shaving cream so that when an operator is operated and shaving cream is released, it will be ejected at the brush for use in shaving.

9 Claims, 3 Drawing Figures

SHAVING DEVICE

FIELD OF THE INVENTION

This invention relates to a shaving device and, more particularly to a shaving device which includes a razor blade and a supply of shaving cream in a device for convenience in shaving.

BACKGROUND OF THE INVENTION

In the past, it has been noted that numerous men desire to shave more than once a day and desire to have a shaving device which they can carry with them. A problem has been that shaving cream is not accessible or available at all times. This invention is of a shaving device which carries with it a supply of shaving cream to be released and which supply is included within the same device which includes the razor blade.

It is, accordingly, an object of this invention to provide an improved shaving device which is portable and which can be used, especially for travelers, in shaving at the locations where a shaving cream is not otherwise available and wherein the device includes a cartridge of shaving cream which is releasable to a brush adjacent the razor blade so that shaving can be accomplished with the device conveniently.

In accordance with these and other objects which will become apparent hereinafter, the instant invention will now be described with reference to the accompanying drawings, in which:

DESCRIPTION OF PREFERRED EMBODIMENT

Figure 1:
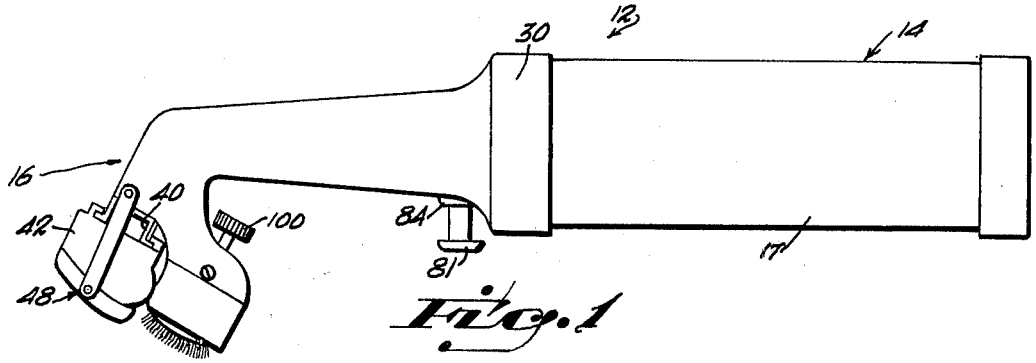
FIG. 1 is a side elevation view of a shaving device constructed in accordance with this invention.
Figure 2:
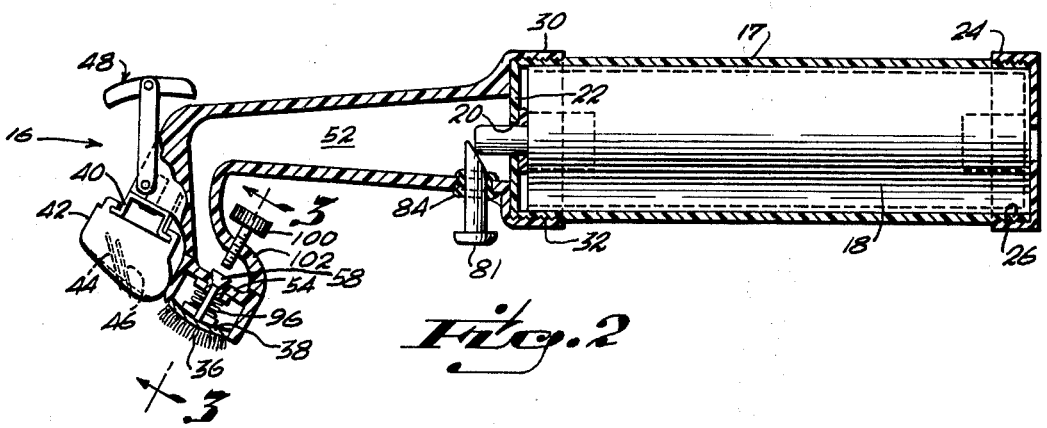
FIG. 2 is a view in cross section taken on a vertical longitudinal center plane through the device as shown in FIG. 1.
Figure 3:
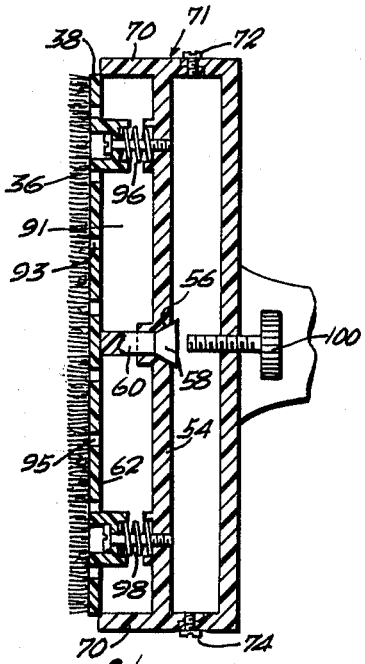
FIG. 3 is a view in cross section taken on the plane indicated by the line 3—3 of FIG. 2 and looking in the direction of the arrows.

Referring to the drawings wherein like reference characters designate like or corresponding parts throughout the several views, the numeral 12 generally designates the shaving device which includes a handle end zone 14 and a shaving end zone 16. The handle end comprises a tubular portion 17 with an interior chamber sized to receive an aerosol container 18 of shaving cream. The container has a release valve operator and nozzle extending through an opening 20 in the end wall at the inner end 22 of the handle end zone. A cap 24 is provided in screw-threaded engagement with the rear end 26 to close and seat the aerosol container. Extending from the end wall 22 of the handle 22 there is a tubular shaving or operating end zone 16 which at the rear end includes a skirt 30 internally threaded for threaded engagement with threads 32 on the outside of the inner end of the handle portion. At the terminal end of the operating portion a brush 36 and carrier 38 therefore is provided, as well as a razor blade cartridge holder 40 to receive the blade cartridge 42 with the blades 44 and 46 secured therein. Further, a pivotal guard or shield arrangement 48 is provided for pivotal movement on the device from the position shown in FIG. 1 of protective covering of the blades to the position shown in FIG. 2 for use of the razor blades. A through passageway 52 is provided through the operating portion to the brush end. Adjacent the outer end there is a septum 54 with a through opening 56, which is normally closed by a valve 58 which seats in the opening. The valve includes an outwardly extending stem 60 which abuts the adjacent surface of a brush carrier 62, which is sized so as to be inwardly and outwardly movable with respect to the septum within the space defined by the extending outer walls 70. In the preferred embodiment the terminal end comprises a carrier 71 which is in threaded engagements as at 72 and 74 with the end of the unit.

In use, a container is inserted into the handle portion. Thereafter, shaving cream is dispensed by pressing the operator 81 inwardly which is slidably arranged in a hole 82 about which seals 84 are provided for sliding cam-type engagement to depress the operator 81 of the container to eject shaving cream into the chamber or passageway 52, filling it. When a person desires to use the device, when he presses it to his skin, the brush surface will react to the pressure by moving inwardly causing the valve 58 to unseat and permitting the shaving cream under pressure to enter into the space designated by the numeral 91 to pass through the pattern of holes such as 93, 95, etc. into the brushes to be dispensed on the face. A person then rotates the guard or shield 48 to the out-of-the-way position and shaves. As more shaving cream is needed, the operator knob 81 is depressed and the cycle repeated.

A pair of screw and compression spring assemblies 96 and 98 connect between the brush carrier 38 and the septum 58 to provide for resilient movement of said carrier when the shaving device is in use. A thumb screw 100, through wall 102, in axial alignment with valve 58, adjustably limits the amount of opening of the valve 58 when the carrier 38 is depressed against the forces of the springs of assemblies 96 and 98.

What is claimed is:

1. A shaving device comprising:

a handle of tubular material having a first end and a second end and comprising a housing;

a cartridge in the housing in fitted relation;

a cap means in closing relation of the first end, means closing the second end and having a through opening and said cartridge having a valve member extending through the opening, a blade carrying member having a working end and including a stem with an open end fixed about the second end, said stem having a through passageway leading from the open end to the working end, razor blade carrying means on the working end, and an opening in the working end adjacent the blade carrying means, said opening being in open communication with said passageway, and valve means normally closing the opening and including a carrier and biasing means yieldable to a force to open the opening and brush means on the carrier, and an operator exteriorly accessible on the stem for the valve member of the cartridge and means manually mounting the operator on a stem adjacent the second end of said housing and movable between a normal valve member closed position and a valve member open position to permit escape of shaving cream into the passageway to be selectively released by pressure on the brush to open said valve means.

2. The device as set forth in claim 1 wherein means are provided to limit movement of said valve member.

3. The device as set forth in claim 2 wherein adjustment means are provided to adjust said means to limit.

4. The device as set forth in claim 1 wherein said carrier includes a plate form body having a plurality of through openings and an exterior surface and an interior surface and said brush means are fixed on said exterior surface.

5. The device as set forth in claim 4 wherein the exterior surface of said plate form body is provided with spaced recesses and float means mounting the body to the working end.

6. The device as set forth in claim 1 wherein said carrier comprises an open work in covering relation and spaced from said opening and said carrier and said working end about said opening comprise a chamber for dispersal of shaving cream entering the chamber to the brush means and through said plate form.

7. The device as set forth in claim 1 wherein the working end includes a septem means 54 with said opening 56 and means 72 and 74 to connect said septum means to said working end.

8. The device as set forth in claim 1 wherein the stem includes a hole adjacent the second end and said operator comprises a member having a first end in the passageway with means in mating engagement with said valve member and a shank extending through the hole and a second end exteriorly of the stem with button means to move the operator to operate the valve member of the cartridge.

9. The device as set forth in claim 1 wherein said cap means comprises a cap having an annular skirt in threaded engagement with the first end of the handle.

* * * * *